United States Patent [19]

Olszewski

[11] 4,254,629

[45] Mar. 10, 1981

[54] CRYOGENIC SYSTEM FOR PRODUCING LOW-PURITY OXYGEN

[75] Inventor: Walter J. Olszewski, Tonawanda, N.Y.

[73] Assignee: Union Carbide Corporation, New York, N.Y.

[21] Appl. No.: 145,882

[22] Filed: May 1, 1980

Related U.S. Application Data

[63] Continuation-in-part of Ser. No. 903,407, May 8, 1978, abandoned.

[51] Int. Cl.[3] ..... F25J 3/04

[52] U.S. Cl. ..... 62/13; 62/29; 62/38

[58] Field of Search ..... 62/13–15, 62/29, 30, 38, 39

[56] References Cited

U.S. PATENT DOCUMENTS

| | | | |
|---|---|---|---|
| 2,209,748 | 7/1940 | Schlitt | 62/29 |
| 2,664,719 | 1/1954 | Rice et al. | 62/29 |
| 2,682,162 | 6/1954 | Langer | 62/29 |
| 2,765,637 | 10/1956 | Etienne | 62/29 |
| 2,812,645 | 11/1957 | Locklair et al. | 62/29 |
| 2,934,907 | 5/1960 | Scofield | 62/29 |
| 3,066,494 | 12/1962 | Potts | 62/29 |

*Primary Examiner*—Norman Yudkoff

*Attorney, Agent, or Firm*—Steven J. Hultquist; Stanley Ktorides

[57] ABSTRACT

Low purity oxygen is produced by factional distillation of liquefied air in a double distillation column and an auxiliary distillation column. Feed air is supplied at two different pressures. The disclosed methods of handling intermediate oxygen-enriched liquid produced by the two columns and removing nitrogen-rich gas from the auxiliary distillation column permit the system to operate with lower energy requirements and smaller column diameter than conventional systems.

17 Claims, 3 Drawing Figures

CRYOGENIC SYSTEM FOR PRODUCING LOW-PURITY OXYGEN

This application is a continuation-in-part of prior U.S. application Ser. No. 903,407, filed May 8, 1978, and now abandoned.

BACKGROUND

This invention relates to the low-temperature distillation of air to obtain low-purity oxygen and nitrogen-rich products. The term "low-purity oxygen" as used throughout the present specification and claims is intended to mean a product having an oxygen content of less than 99.5 mole percent.

It is believed that very large quantities of low purity oxygen will be required by processes now being developed for converting coal to liquid or gaseous products. Another use for low purity oxygen is in a process for converting refuse to useful gaseous products as described in Anderson U.S. Pat. No. 3,729,298. Hence, a process for producing low-purity oxygen in large quantities at low cost is desirable.

A common system for low temperature fractionation employs a higher pressure distillation column having its upper end in heat exchange relation with the lower end of a lower pressure distillation column. Cold compressed air is separated into oxygen-enriched and nitrogen-rich liquids in the higher-pressure column and these liquids are transferred to the lower-pressure column for separation into nitrogen- and oxygen-rich products. Examples of this double-distillation column system appear in Ruheman's "The Separation of Gases," Oxford University Press, 1945.

Large quantities of energy are required to compress the feed air for such a process. Hence, in these times of rising energy costs, a saving of energy is important. Another problem associated with conventional systems is the large diameter of the lower pressure column, which must handle substantially all of the air fed to the system at relatively low pressure. One way to reduce the energy cost of the low-temperature distillation of air, as disclosed by Potts in U.S. Pat. No. 3,066,494, is by a dual-feed-pressure process. Such a process compresses only part of the feed air to the operating pressure of the higher pressure distillation column. The remainder of the feed air is compressed to a lower pressure and fed to the lower pressure column. The difficulty with the Potts process is that the maximum oxygen purity attainable is limited to about 90 mole percent. This limitation results from the low-pressure feed stream's by-passing the higher pressure column and entering the lower pressure column without having had the benefit of a prior separation. Furthermore, use of the Potts process does not achieve a reduction in the diameter of the lower pressure distillation column.

Schlitt, in U.S. Pat. No. 2,209,748 discloses a dual-feed-pressure process that uses an auxiliary column to remove a portion of the nitrogen from the low-pressure feed stream prior to feeding the low-pressure stream into the lower pressure column. Schlitt eliminates the higher pressure column. Schlitt's process is able to achieve purities in excess of 90 mole percent at reduced, but still relatively high energy costs. However, the present invention is able to achieve energy usage even lower than that of Schlitt.

OBJECTIVES

Accordingly, it is an object of this invention to cryogenically separate air into low-purity oxygen and nitrogen-rich streams with reduced energy requirements.

It is a further object of this invention to cryogenically separate air into low-purity oxygen and nitrogen-rich streams using a lower pressure distillation column of reduced diameter.

SUMMARY OF THE INVENTION

These and other objects are achieved by the present invention one aspect of which comprises:

A process for producing low-purity oxygen from feed air by low temperature distillation comprising the steps of:

(a) supplying a high-pressure gas feed stream, comprising at least 35 percent of said feed air, at pressure of at least 65 psia, in a cleaned, cooled state, (b) distilling said high-pressure gas feed stream in a higher-pressure distillation column so as to produce first intermediate oxygen-enriched liquid at the lower end and first nitrogen-rich gas at the upper end of said column, (c) heat exchanging the first nitrogen-rich gas with colder oxygen-enriched liquid so as to condense the first nitrogen-rich gas as reflux for said higher-pressure distillation column and a lower-pressure distillation column while simultaneously vaporizing the oxygen-enriched liquid as vapor for upward flow through said lower-pressure distillation column, (d) supplying a low-pressure gas feed stream, comprising no more than 65 percent of said feed air, at pressure of from 40 to 80 psia, but at least 10 psia less than the pressure of said high pressure feed stream, in a cleaned, cooled state.

(e) distilling the low-pressure gas feed stream against a colder liquid reflux in an auxiliary distillation column so as to produce second intermediate oxygen-enriched liquid at the lower end and second nitrogen-rich gas at the upper end of said auxiliary distillation column, (f) expanding a portion of the intermediate oxygen-enriched liquid and introducing same to the lower-pressure distillation column, (g) removing a portion of the second nitrogen-rich gas from the upper end of the auxiliary distillation column, in an amount equal to the molar flow rate of between 20 and 70 percent of the molar flow rate of the low-pressure gas feed stream, as product, (h) expanding substantially the remainder of the unexpanded intermediate oxygen-enriched liquid, separately from the liquid of step (f), and indirectly heat exchanging said remainder with the unremoved second nitrogen-rich gas, outside of the aforementioned distillation columns, condensing said unremoved second nitrogen-rich gas and at least partially vaporizing the remainder of the intermediate oxygen-enriched liquid, (i) introducing at least a part of the condensed second nitrogen-rich vapor to the auxiliary distillation column as said colder liquid reflux therefor, (j) introducing the expanded and at least partially vaporized oxygen-enriched mixture formed in step (h) to the lower pressure distillation column, and (k) distilling the streams introduced to the lower pressure distillation column so as to produce a product stream of low-purity oxygen at the bottom thereof and a nitrogen-rich gas stream at the top thereof.

Another aspect of the invention comprises:

Apparatus for producing low-purity oxygen by air separation by low-temperature distillation comprising:

(a) means for compressing at least a first feed air stream to a pressure of at least 65 psia, (b) means for cooling at least said first stream, (c) a double distillation column comprising a higher-pressure distillation column for operation at a pressure of at least 65 psia, a lower-pressure distillation column for operation at a pressure no higher than 80 psia, but at least 10 psia less than said higher pressure distillation column, and a heat exchanger joining the upper end of the higher-pressure distillation column and the lower end of the lower-pressure distillation column, (d) conduit means for flowing the cooled, first stream to the higher-pressure distillation column for separation therein, (e) means for supplying a second feed air stream at pressure of between 40 to 80 psia, in a cooled state, (f) an auxiliary distillation column with an auxiliary heat exchanger at its upper end, (g) conduit means for flowing the cooled, second feed air stream to the auxiliary distillation column, (h) conduit means for flowing nitrogen rich liquid from the heat exchanger of part (c) to said lower-pressure distillation column, (i) conduit means for transferring intermediate oxygen enriched liquid to the lower pressure distillation column and separately to the auxiliary heat exchanger, (j) means for discharging a nitrogen-rich stream from the upper end of said auxiliary distillation column, (k) conduit means for flowing at least partially vaporized oxygen-enriched mixture from the auxiliary heat exchanger to the lower-pressure distillation column, (l) means for discharging product low-purity oxygen from the lower end of the lower pressure distillation column, and (m) means for discharging a nitrogen-rich stream from the upper end of the lower pressure distillation column.

The term "cleaned, cooled state" as used throughout the present specification and claims is intended to mean that high-boiling impurities, such as water and carbon dioxide, are removed from the feed streams, and that the streams are cooled to near their dew points at their respective pressures. The preferred method of cleaning and cooling the feed air is by reversing heat exchange with the product low-purity oxygen and nitrogen-rich gas streams.

The term "intermediate oxygen enriched liquid" as used throughout the present specification and claims is intended to mean the oxygen enriched liquid that forms at the lower ends of the higher pressure and/or auxiliary columns.

All percent compositions refer to mole percents.

The preferred percent oxygen in the product is between above 90 percent with between 95 and 99.5 percent being most preferred.

It is preferred that the high-pressure feed stream comprise 50 to 60 percent of the total feed air and be compressed to a pressure of between 75 and 95 psia. The preferred pressure for the low-pressure feed stream is between 45 and 70 psia. The preferred molar flow rate of nitrogen-rich gas withdrawn from the upper end of the auxiliary column is between 40 and 60 percent of the molar flow rate of the low-pressure feed stream.

As used herein, "indirectly heat exchanging" means that the respective streams involved in the heat exchange process are brought into heat exchange relationship without any physical contacting or intermixing of such streams with one another. Indirect heat exchange may thus for example be effected by passage of the heat exchange streams through a heat exchanger wherein the streams are in distinct passages and remain physically segregated from one another in transit through the exchanger.

The term "product," as used herein refers to a gaseous or fluid stream which is discharged from a distillation column in the process system without further distillation separation therein.

"Distillation" and "distilling" as used herein refer to separation of fluid mixtures in a distillation column, i.e., a contacting column wherein liquid and vapor phases are countercurrently and adiabatically contacted to effect separation of a fluid mixture, as for example by contacting of the vapor and liquid phases on a series of vertically spaced-apart trays or plates mounted within the column, or, alternatively on packing elements with which the column is filled. For an expanded discussion of the foregoing, see the Chemical Engineers' Handbook, Fifth Edition, edited by R. H. Perry and C. H. Chilton, McGraw-Hill Book Company, New York, Section 13, "Distillation," B. D. Smith et al, page 13–3, *The Continuous Distillation Process.*

IN THE DRAWINGS

DETAILED DESCRIPTION OF THE INVENTION

Figure 1:
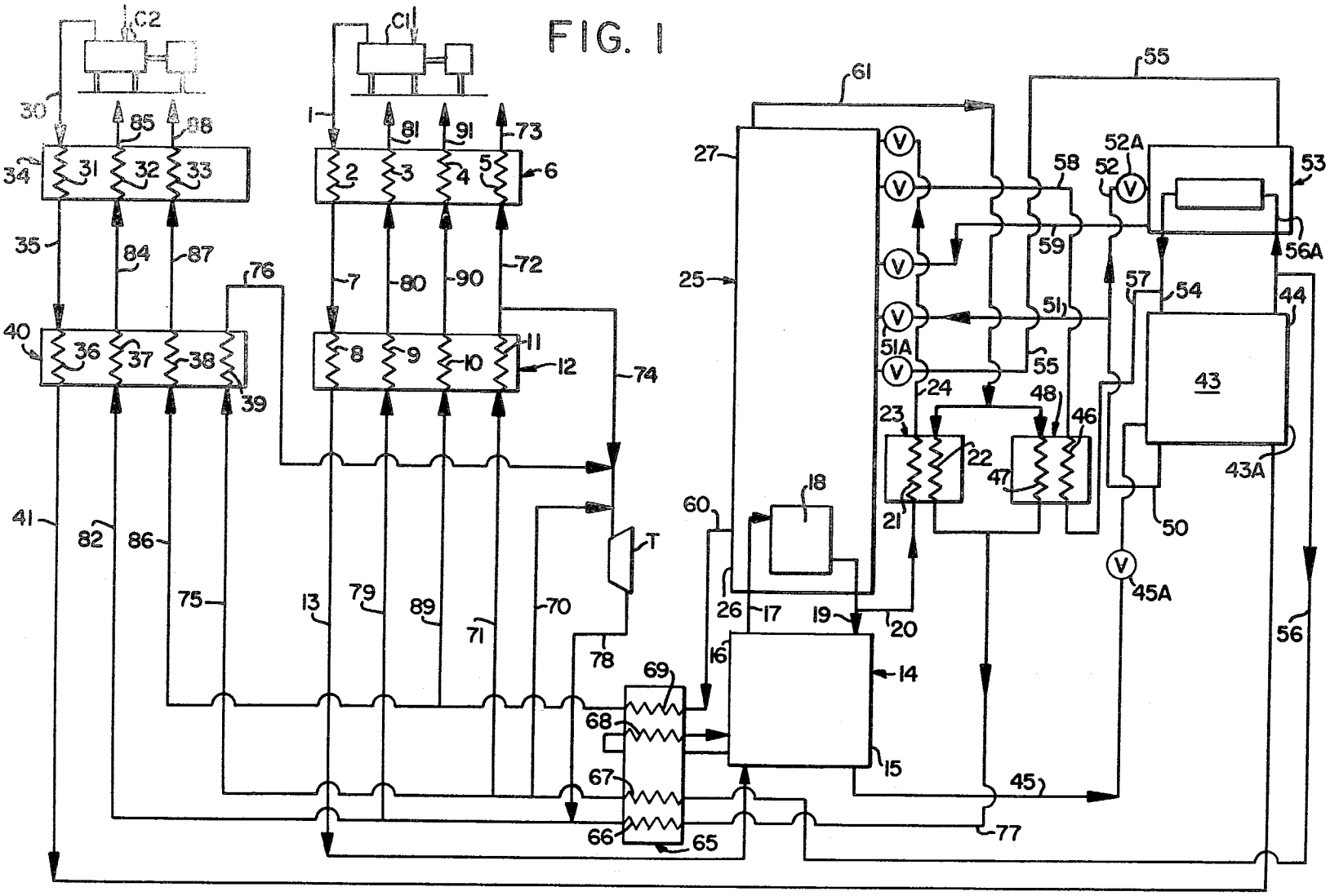
FIG. 1 is a schematic flowsheet of a complete system for producing low-purity oxygen in accordance with a preferred embodiment of the invention.

Referring now to FIG. 1, the cryogenic separation is carried out in three distillation columns: higher pressure distillation column 14 whose upper end is in heat exchange relation with the lower end of lower pressure distillation column 25, and auxiliary distillation column 43. The system functions as follows. The operating conditions given are typical and represent a preferred embodiment for producing about 2000 tons of oxygen per day having a purity of 98 percent, as shown in Example I and Table I.

Ambient air is compressed to a pressure of 92 psia in compressor C1, forming a high pressure feed stream. This stream may be cooled by heat exchange with water to about 305° F. in means not shown. The high pressure feed flows by conduit 1 to passageway 2 of reversing heat exchanger 6 where it is further cooled by heat exchange with products leaving the system. The high pressure feed then flows by conduit 7 to passageway 8 of reversing heat exchanger 12, where it is further cooled by products leaving the system to about, for example 105° K., which is near its saturation temperature. The high pressure feed then flows by conduit 13 to higher pressure distillation column 14.

Both the high-pressure feed stream, described above, and the low-pressure feed stream, described later, must be supplied to the system in a cleaned, cooled state. The preferred method of cleaning and cooling the feed streams is by heat exchange with the products of the system in well-known reversing heat exchangers, wherein the incoming feed is cooled and simultaneously high boiling impurities, such as water and carbon dioxide, are desublimed and deposited onto the walls of the heat exchanger. Before the solid deposit fouls the heat exchanger, the feed air stream is switched to a second passageway by valve and conduit means (not shown), and a product stream, such as one of the nitrogen-rich gas steams, is passed through the passageway of the reversing heat exchanger containing the solid water and carbon dioxide deposits, causing these impurities to vaporize and leave the system. Contamination of the product streams with these impurities may be tolerated as the products are intended to be low-purity. Before the second passageway handling the feed air stream fouls, the feed air is diverted to the cleared passageway and the outgoing product stream is used to remove impurities from the second passageway. Of course, any means for cleaning and cooling the feed streams may be used with the invention, such as regenerative heat exchangers, gel traps, molecular sieves, external refrigeration, or combinations thereof.

The high-pressure feed must be compressed to at least 65 psia and preferably to at least 75 psia. The most preferred pressure for the high-pressure feed stream is between 75 and 95 psia. The high-pressure feed must comprise at least 35 percent of the feed air, and preferably 50 to 60 percent of the feed air. Most preferably, the high pressure feed stream comprises between 52 and 56 percent of the total air fed to the system.

In higher pressure distillation column 14, the high-pressure feed is separated by distillation into a first intermediate oxygen-enriched liquid that flows to the lower end 15 of column 14 and a first nitrogen-rich gas that rises to the upper end 16 of column 14.

The first nitrogen-rich gas flows via conduit 17 to heat exchanger 18, a condenser-evaporator well known in the art, where it is heat exchanged with a colder oxygen-enriched liquid, the formation of which will be described later. The first nitrogen-rich gas is condensed, and a portion of the condensate is refluxed to higher pressure column 14 by conduit 19. The remainder of the condensate flows by conduits 20 and 24 to the upper end 27 of lower pressure distillation column 25 for reflux therein. This reflux, which must be expanded prior to its introduction to column 25, may be cooled in passageway 21 of heat exchanger 23 prior to being introduced to column 25.

The oxygen enriched liquid at the lower end 26 of column 25 is vaporized in heat exchanger 18 by heat exchange with the first nitrogen-rich gas. The oxygen enriched vapor so formed flows upward through column 25.

A low-pressure feed stream is supplied to the system by compression in compressor C2 to about 60 psia. This feed may be cooled with water to about 305° F. The low pressure feed flows by conduit 30 to passageway 31 of reversing heat exchanger 34, where the feed is further cooled. The low-pressure feed then flows by conduit 35 to passageway 36 of reversing heat exchanger 40 where it is further cooled to, for example, 103° K. When the low-pressure feed has reached conduit 41, it is in a cleaned, cooled state resulting from reversing heat exchange with outgoing products similar to the manner in which the high-pressure stream was cleaned and cooled. The cleaned, cooled low-pressure feed flows by conduit 41 to auxiliary distillation column 43.

The low-pressure feed must comprise no more than 65 percent of the feed air and be supplied to the system at a pressure of between 40 and 80 psia, but at least 10 psia, and preferably at least 20 psia, less than the pressure of the high-pressure feed stream. Preferably, the low-pressure stream is at a pressure of between 45 and 70 psia, with 50 to 65 psia being most preferred. Relative to the operating pressures of the high pressure, low pressure and auxiliary columns, highly efficient operation may be achieved in the preferred practice of the present invention by operating the high pressure distillation column at pressure of 65 to 130 psia, the low pressure distillation column at pressure of 18 to 30 psia and the auxiliary distillation column at pressure of 40 to 80 psia.

In the auxiliary column the low-pressure feed is distilled against colder liquid to produce a second intermediate oxygen-enriched liquid at the lower end 43A of column 43 and a second nitrogen-rich gas at the upper end 44 of column 43.

The handling of the first and second intermediate oxygen-enriched liquids, which form at the lower end 15 of low-pressure column 14 and lower end 43A of auxiliary column 43, is a key step in the energy saving of this invention. A portion of these oxygen-enriched liquids must be used as a liquid feed to lower pressure distillation column 25. The remainder of these liquids must be expanded and used to cool a portion of the second nitrogen-rich gas thereby condensing part of the second nitrogen-rich gas and at least partially vaporizing the remaining intermediate oxygen-enriched liquid. It is preferred to vaporize substantially all of the remaining intermediate oxygen-enriched liquid. Intermediate oxygen-enriched liquid so vaporized must then be introduced to the lower pressure distillation stage. FIG. 1 shows a preferred method of handling these liquids. The first intermediate oxygen-enriched liquid at, for example, 88 psia, containing about 39 percent oxygen, flows by conduit 45 from the lower end 15 of column 14 to the lower end 43A of auxiliary column 43. This liquid is expanded in expansion valve 45A prior to entry into column 43. Hence, the lower end 43A of auxiliary column 43 contains a mixture comprised of the first and second intermediate oxygen-enriched liquids, having about 41.7% oxygen and pressure of about 56 psia. A portion of the intermediate, oxygen-enriched liquid mixture flows to expansion valve 51A by conduits 50 and 51 and is expanded through valve 51A prior to being introduced into lower pressure distillation column 25. The remainder of intermediate oxygen-enriched liquids flows by conduits 50 and 52 to valve 52A and is expanded into auxiliary heat exchanger 53.

Alternate methods of handling the intermediate oxygen-enriched liquids, produced at the lower ends of columns 14 and 43 will also accomplish the objects of the invention. However, one portion of these liquids must be used as a liquid feed to lower pressure column 25 and substantially the remainder must be separately expanded to supply refrigeration in heat exchanger 53 and subsequently introduced into lower pressure column 25 as a vapor feed. For example, the first intermediate oxygen-enriched liquid could flow directly from the lower end 15 of the higher pressure column 14 to lower pressure column 25, and the second intermediate oxygen-enriched liquid could flow from the lower end 43A of auxiliary column 43 to heat exchanger 53. Another method would be to have the two liquids crisscross, i.e. the first intermediate oxygen-enriched liquid could flow to heat exchanger 53 and the second intermediate oxygen-enriched liquid could flow to low pressure column 25. Any method of using the intermediate oxygen-enriched liquids to provide (a) a separate liquid feed to low pressure column 25 and (b) separate cooling to condense part of the second nitrogen-rich gas followed by feeding of the vaporized intermediate oxygen-enriched liquid to lower pressure column 25 will achieve the objects of this invention. Feeding all the intermediate oxygen enriched liquid to auxiliary condenser 53 for partial vaporization therein, followed by introducing the partially vaporized material so formed to lower-pressure column 25 will not provide the separate liquid and vapor feed streams for lower pressure column 25 needed to achieve the low energy usage of this invention.

A portion of the second nitrogen-rich gas in an amount equal to the molar flow rate of between 20 and 70 percent of the molar flow rate of the low-pressure feed stream must be removed from the upper end 44 of auxiliary column 43. Conduit 56 conducts nitrogen-rich gas from the auxiliary column. The amount of nitrogen-rich gas removed must be within these limits because, if too much gas is removed, auxiliary column 43 will not have sufficient reflux. If too little gas is removed, the amount of oxygen-enriched liquid required for condensation in auxiliary condenser 53 becomes so large that insufficient liquid would be left to introduce to lower pressure column 25. The molar flow rate of the second nitrogen-rich gas removed from the upper end of auxiliary column 43 is preferably between 40 and 60 percent of the low-pressure feed, with between 45 and 55 percent being most preferred. The oxygen content of the second nitrogen-rich gas removed from the upper end of the auxiliary column will typically, in the general practice of this invention, be less than 2 mol% and preferably is less than 1 mol%.

The portion of the second nitrogen-rich gas removed from auxiliary column 43 by conduit 56 does not have to be processed in lower pressure distillation column 25, hence, the diameter of column 25 can be substantially smaller than it would be if column 25 handled all the air fed to the system. An additional benefit of second nitrogen-rich gas removal is an extra product stream. The preferred method of handling all product streams is described later.

The unremoved portion of the second nitrogen-rich gas flows by conduit 56A to auxiliary heat exchanger 53, where the gas is condensed by heat exchange with the portion of the intermediate oxygen-enriched liquids which was not introduced to lower-pressure column 25 as liquid. This intermediate oxygen-enriched liquid is introduced to auxiliary heat exchanger 53 by conduit 52 and expansion valve 52A. The condensed second nitrogen-rich gas is introduced to auxiliary column 43 as reflux via conduit 54, thereby providing the colder liquid necessary to rectify the low-pressure feed. A small portion of the condensed second nitrogen-rich gas may flow by conduits 57 and 58 to column 25, providing additional reflux to column 25. The material in conduit 57 may be cooled by heat exchange with outgoing nitrogen-rich gas in passageway 46 of heat exchanger 48.

The portion of the intermediate oxygen-enriched liquids vaporized in auxiliary heat exchanger 53 flows by conduit 55 to lower pressure column 25. It is desirable that a very small portion of the intermediate oxygen-enriched liquid introduced to auxiliary heat exchanger 53 remain in the liquid state and flow by conduit 59 to lower pressure column 25. This very small stream removes hydrocarbons from heat exchanger 53. Hydrocarbons are present in the feed air in very small quantities and could accumulate in condenser 53, tending to form an explosive mixture. A small flow of liquid in conduit 59 prevents this potentially hazardous occurrence.

The streams introduced to lower pressure distillation column 25 are distilled to produce the oxygen-enriched liquid at lower end 26 of column 25 and nitrogen-rich gas at upper end 27. As described previously, the oxygen-enriched liquid is vaporized by heat exchange with the first nitrogen-rich gas in heat exchanger 18. The vaporized oxygen-enriched liquid flows upward through column 25. A product stream of low-purity oxygen of 98 percent purity is removed from column 25 in conduit 60. A product stream of nitrogen-rich gas of 99 percent purity is removed in conduit 61.

The method of handling product streams 56, 60 and 61, is optional; however, the preferred method described below produces high energy efficiency. The nitrogen-rich gas stream in conduit 56, containing the second nitrogen rich gas removed from column 43 may be used to supply refrigeration to higher pressure column 14 by heat exchange with the first intermediate oxygen-enriched liquid in heat exchanger 65. This nitrogen-rich gas flows through passageway 67 of heat exchanger 65. After heat exchanger 65, the nitrogen-rich gas removed from auxiliary column 43 may be divided into three portions. The first portion is fed by conduit 70 to turbine T for work expansion to produce auxiliary refreigeration for the process. A second portion flows by conduit 71 to passageway 11 of heat exchanger 12 where the nitrogen-rich gas is used to help cool the incoming high-pressure feed air stream. After exiting heat exchanger 12, part of this nitrogen-rich stream flows through conduit 72 to passageway 5 in heat exchanger 6, absorbing more heat from the incoming high pressure stream, and then out of the system as an uncontaminated product by conduit 73. The other part of the nitrogen-rich gas exiting heat exchanger 12 flows by conduit 74 to turbine T, for work expansion therein. The third portion of the nitrogen-rich gas exiting passageway 67 of heat exchanger 65 flows by conduit 75 to passageway 39 in heat exchanger 40, where it helps to cool the incoming low-pressure feed stream. This gas then flows to turbine T by conduit 76 for work expansion.

The nitrogen-rich stream leaving the upper end 27 of lower pressure column 25 in conduit 61 may flow through passageway 22 of heat exchanger 23 and through passageway 47 of heat exchanger 48 to cool the reflux streams about to be introduced to lower pressure column 25. Then this nitrogen-rich stream may flow by conduit 77 to passageway 66 of heat exchanger 65 to provide refrigeration to higher pressure column 14. After exiting passageway 66, this nitrogen-rich stream is combined with the expanded vapor leaving turbine T in conduit 78. The mixture of nitrogen-rich gases so formed is divided into two portions, each of which is used to remove impurities deposited on the walls of reversing heat exchangers 6, 12, 34 and 40, and to provide refrigeration to the incoming feed streams. The first portion flows by conduit 79 to passageway 9 of heat exchanger 12, then by conduit 80 to passageway 3 of heat exchanger 6, and finally from the system as an air-impurity containing product by conduit 81. The second portion of the nitrogen-rich gas mixture flows similarly through conduit 82, passageway 37 of heat exchanger 40, conduit 84, passageway 32 of heat exchanger 34, and finally from the system as an air impurity containing product by conduit 85. The impurities in these products consist of water and carbon dioxide removed from the walls of the reversing heat exchangers.

The low-purity oxygen leaving lower pressure column 25 in conduit 60 may provide refrigeration to higher pressure column 14 in passageway 69 of heat exchanger 65. The low-purity oxygen stream is then split into two parts. The first part helps cool the incoming high pressure feed stream by flowing through conduit 89, passageway 10 of heat exchanger 12, conduit 90, passageway 4 of heat exchanger 6, and finally from the system as a product via conduit 91. The second part of the low-purity oxygen product cools the low pressure feed stream by flowing through conduit 86, passageway 38 of heat exchanger 40, conduit 87, passageway 33 of heat exchanger 34, and finally from the system as a product by conduit 88.

Table 1 gives flow rates, operating conditions, and compositions of key streams when the invention is

TABLE I

| Conduit Number | Flow Rate ($Nft^3/hr \times 10^{-3}$) | Temperature (°K.) | Pressure (PSIA) | Oxygen Content (mole %) |
|---|---|---|---|---|
| 1 | 5510 | 305 | 92 | 21 |
| 13 | 5510 | 105 | 88 | 21 |
| 30 | 4510 | 305 | 60 | 21 |
| 41 | 4510 | 103 | 56 | 21 |
| 45 | 2860 | 105 | 88 | 39 |
| 50 | 4930 | 95 | 56 | 41.7 |
| 52 | 2710 | 95 | 56 | 41.7 |
| 55 | 2610 | 89 | 23 | 40.8 |
| 56 | 2430 | 87 | 54 | 0.2 |
| 59 | 100 | 89 | 23 | 40.8 |
| 60 | 2057 | 95 | 23 | 98 |
| 61 | 5530 | 80 | 20 | 1.0 |
| 73 | 300 | 302 | 51 | 0.2 |
| 81 | 4210 | 302 | 14.7 | 1.0 |
| 85 | 3450 | 302 | 14.7 | 1.0 |
| 91 | 1131 | 302 | 18.7 | 98 |
| 88 | 926 | 302 | 18.7 | 98 |

practiced according to a preferred embodiment illustrated in FIG. 1, wherein the high pressure column, low pressure column and auxiliary column are provided with 25, 40 and 20 vapor-liquid contacting trays, respectively.

Figure 2:
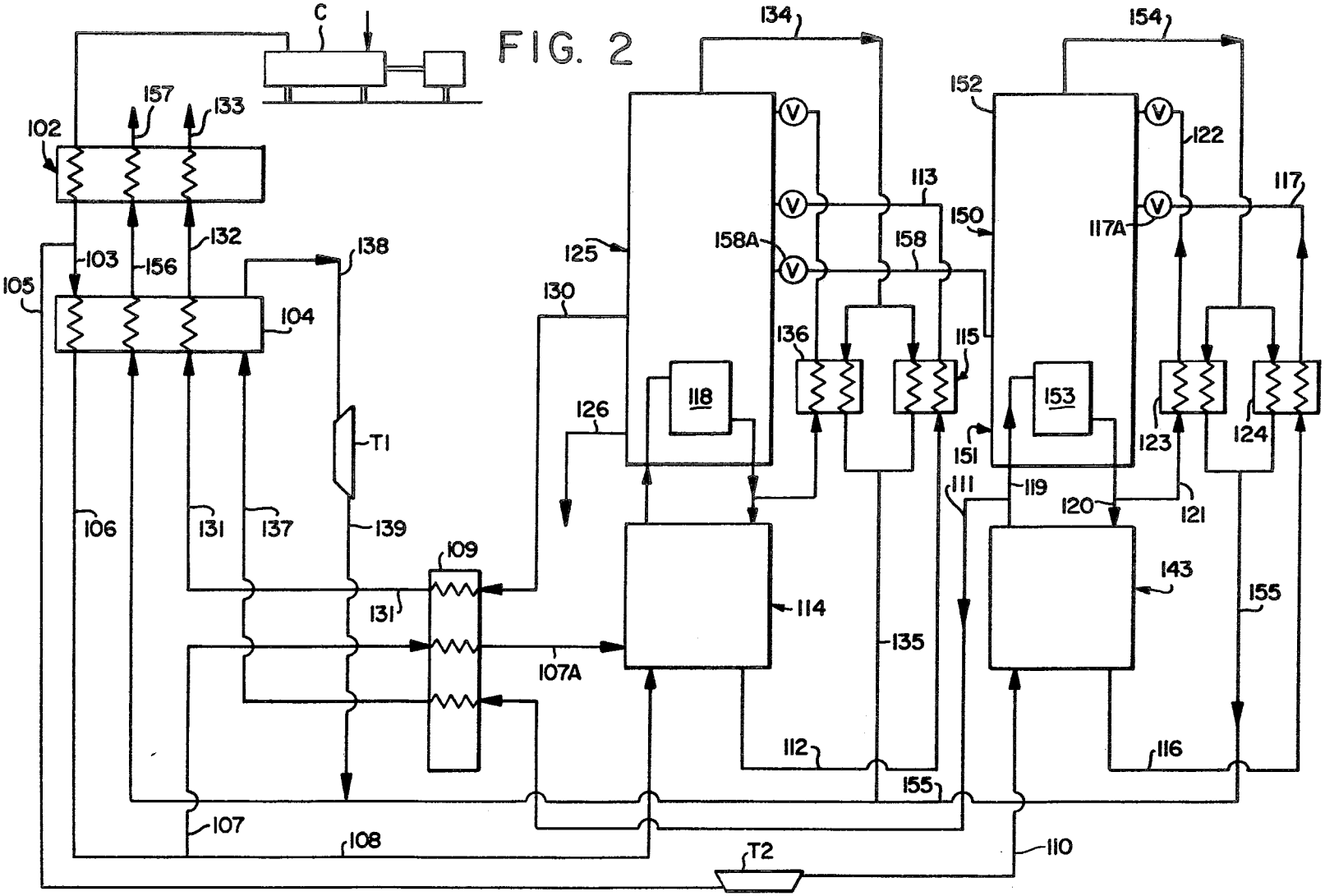
FIG. 2 is a schematic flowsheet of an embodiment of the invention employing an additional turbine for extra refrigeration and an auxiliary upper column for producing higher purity nitrogen.

FIG. 2 illustrates two additional features that may be incorporated into a system for practicing the invention: (1) a second turbine, T2, for obtaining additional refrigeration and (2) and auxiliary upper column 150 for obtaining an additional product stream of nitrogen-rich gas having a relatively high purity. These additional features may be incorporated into the system individually or, as shown in FIG. 2, in combination.

The system illustrated in FIG. 2 functions as follows. Parts of FIG. 2 that function very similarly to corresponding parts of FIG. 1 will not be described in detail.

All of the feed air is compressed to at least 65 psia by compressor C and partially cooled by outgoing products in heat exchange 102. Upon exiting exchanger 102, the feed air is split into two parts. One part flows by conduit 103 to heat exchanger 104 where cooling is completed by heat exchange with outgoing products. This stream, which must comprise at least 35 percent of the feed air, is then delivered by conduits 106, 107, 107A and 108 to higher pressure distillation column 114 as the high pressure gas feed stream. A portion of the high pressure feed stream may be further cooled by outgoing products in heat exchanger 109. Distillation within higher pressure column 114 takes place the same as in FIG. 1, with a first nitrogen-rich gas forming at the upper end of column 114 and a first intermediate oxygen-enriched liquid forming at the lower end of column 114. The first nitrogen-rich gas is condensed against colder oxygen-enriched liquid. The condensate is used as reflux for column 114 and for lower-pressure distillation column 125. The oxygen-enriched liquid is at least partially vaporized in heat exchanger 118 for upward flow in lower-pressure distillation column 125.

The second part of the feed air stream flows by conduit 105 to turbine T2 where it is work expanded to provide additional refrigeration. The additional refrigeration may be required if the system is to operate in a hot climate, or if a portion of the low-purity oxygen product is to be removed in the liquid state, as described below.

The work expanded feed gas stream exists turbine T2 at a pressure of from 40 to 80 psia in a cooled state, constituting the low pressure feed stream to the system. The low pressure feed stream flows via conduit 110 to auxiliary column 143. The low pressure feed stream is distilled in auxiliary column 143 the same as in FIG. 1, forming second intermediate oxygen enriched liquid at the lower end and second nitrogen rich gas at the upper end of column 143. A portion of the second nitrogen rich gas, in an amount equal to the molar flow rate of between 20 and 70 percent of the molar flow rate of the low-pressure feed stream is discharged from column 143 via conduit 111.

The intermediate oxygen enriched liquids, formed at the lower ends of columns 114 and 143 must be handled in the general manner described previously. A portion of these liquids must be used as a liquid feed to lower pressure distillation column 125, and the remainder must provide refrigeration for condensing the unremoved second nitrogen-rich gas thus forming a vapor feed for column 125. Any method of using the first and second intermediate oxygen enriched liquids to accomplish these results will suffice. In FIG. 1, these liquids were combined in the lower end of the auxiliary column prior to being used in the above-described manner. This embodiment is preferred.

FIG. 2 illustrates an alternate way of handling the intermediate oxygen enriched liquids. The first intermediate oxygen-enriched liquid flows from the lower end of column 114 to lower pressure distillation column 125 by conduits 112 and 113. This liquid may be cooled by outgoing nitrogen-rich gas in heat exchanger 115 prior to being expanded into column 125. The second intermediate oxygen enriched liquid flows via conduits 116 and 117 through expansion valve 117A into auxiliary upper column 150 for downward flow therein. This intermediate oxygen enriched liquid may be cooled by outgoing nitrogen rich gas in heat exchanger 124. The lower end 151 of auxiliary column 150 is in heat exchange relation with the upper end of auxiliary column 143. Heat exchange between the two columns takes place in auxiliary heat exchanger 153. The unremoved portion of the second nitrogen-rich gas enters auxiliary heat exchanger 153 by conduit 119, where it is condensed. A portion of the condensate is refluxed to auxiliary column 143 by conduit 120. The remainder of the condensed second nitrogen-rich gas is refluxed to auxiliary upper column 150 by conduits 121 and 122. This reflux may be cooled by outgoing nitrogen-rich gas in heat exchanger 123 prior to being expanded into auxiliary upper column 150. Distillation within the auxiliary upper column 150 takes place at a pressure lower than that of auxiliary column 143 and higher than that of lower-pressure distillation column 125, producing a product nitrogen-rich gas stream at the upper end and an oxygen-enriched gas at the lower end. The product nitrogen-rich gas is discharged from the upper end 152 of auxiliary upper column 150 and conveyed from the system by conduits 154, 155, 156 and 157. This stream may be used to provide refrigeration in heat exchangers 123, 124, 104 and 102.

The oxygen-enriched vapor produced at lower end 151 of auxiliary upper column 150 is introduced by conduit 158 and expansion valve 158A into lower pressure distillation column 125. The streams introduced to lower pressure distillation column 125 are distilled to produce oxygen-enriched liquid at the lower end and nitrogen-rich gas at the upper end of column 125. The oxygen-enriched liquid is maintained in the boiling state by heat exchange with the first nitrogen-rich gas in heat exchanger 118 as described previously. If a liquid product stream of low-purity oxygen is desired, a portion of the oxygen enriched liquid may be discharged from the lower end of column 125 and removed from the process by conduit 126.

It should be kept in mind that the energy requirements of the system increase as more low purity oxygen is removed from the system as a liquid. Of course, it is also possible to remove part of the product of the embodiment shown in FIG. 1 as a liquid, also subject to the penalty of increased energy requirements.

A gaseous product stream of low purity oxygen is discharged from column 125 and conveyed from the system by conduits 130, 131, 132 and 133. This gaseous stream may be used to cool incoming products in heat exchangers 109, 104 and 102.

The nitrogen-rich gas product at the upper end of lower pressure column 125 may be discharged from the column and conveyed by conduit 134 to heat exchangers 115 and 136, where it provides refrigeration, then into conduit 135, where it is combined with the nitrogen-rich gas from the upper end of auxiliary upper column 150 and conveyed from the process by conduits 155, 156 and 157.

The nitrogen-rich gas removed from the upper end of auxiliary column 143 may be conveyed by conduits 111, 137 and 138 into turbine T, where it is work expanded to provide refrigeration to the process. This stream may also be used to cool incoming products in heat exchangers 109 and 104. The nitrogen-rich stream exiting turbine T may be conveyed to conduit 155, and then from the system with the other nitrogen rich streams.

A preferred method of handling the product streams has been illustrated in FIG. 2. Other methods of handling the product streams are within the scope of the invention, since the handling of the product streams is not a part thereof.

Figure 3:
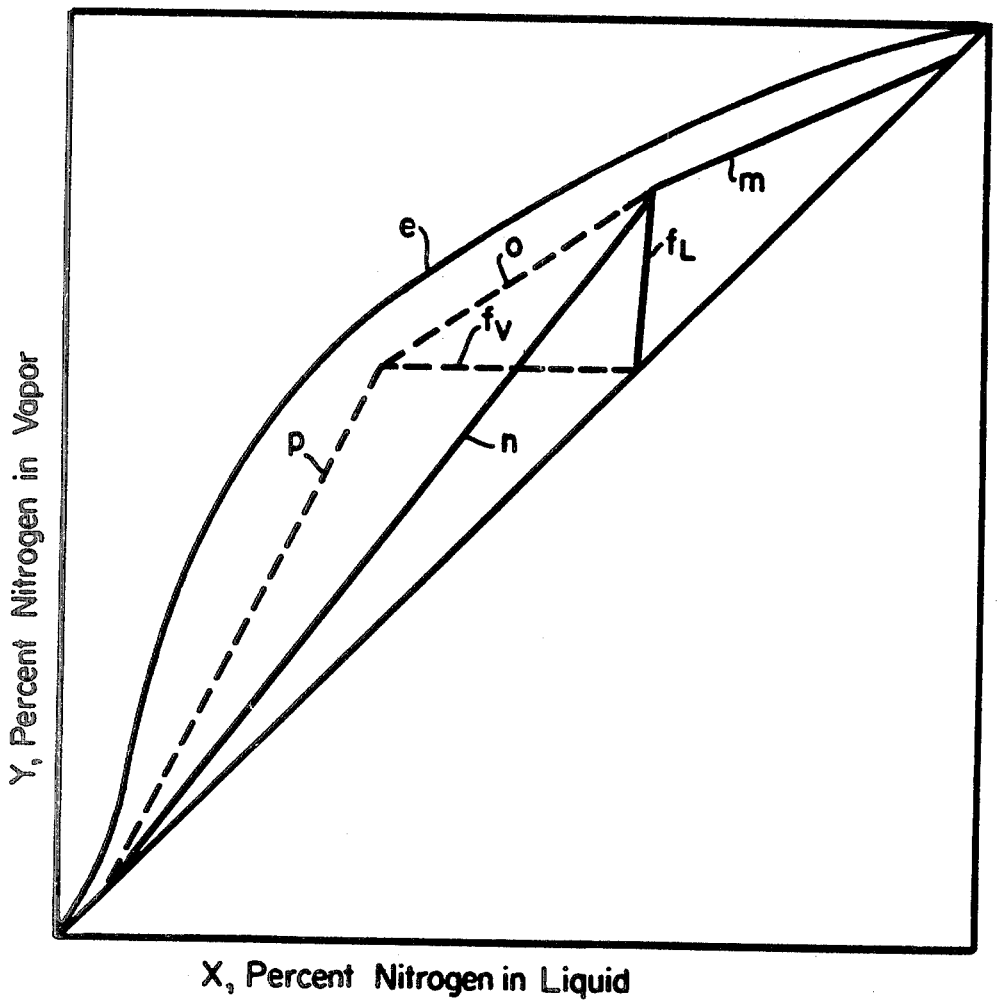
FIG. 3 is a McCabe-Thiele diagram showing how the present invention is able to operate closer to equilibrium conditions, and therefore, with greater energy efficiency.

FIG. 3 is a partial explanation of how the invention is able to achieve energy efficiencies higher than those of the conventional double column process. The figure shows a simplified McCabe-Thiele diagram for the distillations that take place within the lower pressure stages. The McCabe-Thiele graphical analysis of distillation processes is described in detail in McCabe and Smith, "Unit Operations of Chemical Engineering," pages 689 to 708, McGraw-Hill Book Company, 1956. According to this method of analysis, feeds to a distillation column entering the column between the column's upper end and lower end are represented by "feed lines." Hence, for lower pressure column 25 of FIG. 1 only streams 51, 55 and 59 would be represented by "feed lines." A liquid feed is represented by a vertical line and a vapor feed by a horizontal line.

Curve e is the equilibrium curve showing the relationship between X, the precent nitrogen in the liquid, and Y, the percent nitrogen in the vapor. Line $f_L$ is the "feed line" for a stream of oxygen enriched liquid fed to the lower-pressure stage. In the conventional double column process, only one liquid "feed line" is present; hence, the operating lines for such a process are drawn as lines m and n. When distillation in accordance with this invention takes place, at least two "feed lines" may be drawn, a liquid "feed line," for example, in FIG. 1, that which represents the feed in conduit 51, and a vapor "feed line," for example, that representing the feed in conduit 55. The "feed lines" representing these two feeds are $f_L$ for the liquid feed, and $f_V$ for the vapor feed. The operating lines for distillation of the present invention, lines m, o and p, are much closer to equilibrium curve e than those for the conventional process, lines m and n. Since the distillation of the present invention proceeds closer to equilibrium, it takes place with a higher energy efficiency.

EXAMPLE 1

Assume it is desirable to produce 2000 tons per day of oxygen of 98 percent purity and 300,000 NCFH of 99.8 percent nitrogen uncontaminated by high boiling impurities such as water and carbon dioxide from ambient air at a temperature of 305° K. By operating the system illustrated in FIG. 1 at the flow rates and process conditions in Table I, the net energy requirement will be 25310 horsepower. A summary of the results of operating such a system appears in column 1 of Table II.

If a standard double column process were to be used to achieve the same production of low-purity oxygen and uncontaminated nitrogen, the energy equipment would be 27,580 horsepower, as illustrated in column 2 of Table II. This represents an increase of 2270 horsepower or 9.0 percent over the system of the present invention.

If the system disclosed in Schlitt, U.S. Pat. No. 2,209,748 were to be used to accomplish the same production, 26690 horsepower would be required. While the system of Schlitt represents an improvement over the standard double column process, Schlitt's system still requires 1380 more horsepower or 5.4 percent more power than the system of the present invention. The results achievable with Schlitt's system appear in column 3 of Table II.

TABLE II

| | 1. Present Invention | 2. Standard Double Column | 3. Schlitt U.S. Pat. No. 2,209,748 |
|---|---|---|---|
| Ambient Temperature (°K.) | 305 | 305 | 305 |
| High Pressure Feed Stream | | | |
| Percent of total feed | 55 | 100 | 55 |
| Pressure, (PSIA) | 92 | 92 | 92 |
| Flow Rate (N $ft^3$/hr × $10^{-3}$) | 5510 | 9750 | 5920 |
| Low Pressure Feed Stream | | | |
| Percent of total feed | 45 | 0 | 45 |
| Pressure (PSIA) | 60 | — | 55 |
| Flow Rate (N $ft^3$/hr × $10^{-3}$) | 4510 | — | 4845 |
| Oxygen Product | | | |
| Percent oxygen | 98 | 98 | 98 |
| Flow Rate (Tons/Day) | 2000 | 2000 | 2000 |
| Pressure (PSIA) | 18.7 | 18.7 | 18.7 |
| Uncontaminated Nitrogen Product | | | |
| Percent Nitrogen | 99.8 | 99.8 | 99.8 |
| Flow Rate (CFH) | 300,000 | 300,000 | 300,000 |
| Pressure (PSIA) | 50 | 80 | 50 |
| Oxygen recovery as percent of oxygen in total feed air | 96 | 98 | 89 |
| Power Required (HP) | | | |
| To compress high pressure feed stream | 16,000 | 28,190 | 17,250 |
| To compress low pressure feed stream | 10,040 | — | 10,150 |
| Recovered by turbine expansion | −730 | −610 | −710 |
| Net power required | 25,310 | 27,580 | 26,690 |
| New power as percent of present invention | 100 | 109.0 | 105.4 |

EXAMPLE II

Assume it is desired to produce 2000 tons per day of oxygen of 98 percent purity and 300,000 NCFH of 99.8 percent nitrogen uncontaminated by high-boiling air impurities, and that the ambient air temperature is 320° K. Extra refrigeration will be required because of the high ambient temperature. For this example the embodiment of the present invention in which all the feed air is compressed to the pressure of high pressure streams will be used. As illustrated in FIG. 2, the extra refrigeration will be obtained by work expanding a portion of the compressed feed air. However, distillation will take place in apparatus similar to the distillation apparatus of FIG. 1. The results of practicing this embodiment of the present invention are shown in column 1 of Table III. As shown in the table, the net energy requirement will be 28,800 HP.

Achieving the same production with a standard double column system will require 30,704 H.P. Surprisingly the standard double column system requires 1940 extra H.P. or 6.7 percent more power than the present invention, in spite of the fact that all the feed air of both systems was compressed to the same pressure. The more efficient recovery of oxygen in the low purity product, achieved by the present invention, accounts for the difference.

TABLE III

| | Present Invention | Standard Double Column |
|---|---|---|
| Ambient Temperature (°K.) | 320 | 320 |
| High Pressure Feed | | |
| Percent of total feed | 100 | 100 |
| Pressure (PSIA) | 92 | 92 |
| Flow Rate | 9730 | 10,440 |

TABLE III-continued

| | Present Invention | Standard Double Column |
|---|---|---|
| Low Pressure Feed Stream (After work expansion) | | |
| Percent of total feed | 45 | — |
| pressure (PSIA) | 56 | — |
| flow rate | 4380 | |
| Oxygen Product | | |
| Percent oxygen | 98 | 98 |
| Flow Rate (Tons/Day) | 2000 | 2000 |
| Pressure (PSIA) | 18 | 18 |
| Uncontaminated Nitrogen Product | | |
| Percent Nitrogen | 99.8 | 99.8 |
| Flow rate (N $Ft^3$/hr) | 300,000 | 300,000 |
| Pressure (PSIA) | 50 | 81 |
| Power required (HP) | | |
| To compress feed | 29,640 | 31,700 |
| Recovered by turbine expansion of nitrogen | −590 | −960 |
| Recovered by turbine expansion of air | −250 | — |
| Net power required | 28,800 | 30,740 |
| Net power required as percent of present invention | 100 | 106.7 |

Although preferred embodiments have been disclosed herein, it should be understood that there are other embodiments which fall within the spirit and scope of the invention as defined by the following claims.

What is claimed is:

1. A process for producing low-purity oxygen from feed air by low-temperature distillation comprising the steps of:

(a) supplying a high-pressure gas feed stream, comprising at least 35 percent of said feed air, at pressure of at least 65 psia, in a cleaned, cooled state, (b) distilling said high-pressure gas feed stream in a higher-pressure distillation column so as to produce first intermediate oxygen-enriched liquid at the lower end and first nitrogen-rich gas at the upper end of said column;

(c) heat exchanging the first nitrogen-rich gas with colder oxygen-enriched liquid so as to condense the first nitrogen-rich gas as reflux for said higher-pressure distillation column and a lower-pressure distillation column while simultaneously vaporizing the oxygen-enriched liquid as vapor for upward flow through said lower-pressure distillation column;

(d) supplying a low-pressure gas feed stream, comprising no more than 65 percent of said feed air, at pressure of from 40 to 80 psia, but at least 10 psia less than the pressure of said high pressure gas feed stream, in a cleaned, cooled state;

(e) distilling the low-pressure gas feed stream against a colder liquid reflux in an auxiliary distillation column so as to produce second intermediate oxygen-enriched liquid at the lower end and second nitrogen-rich gas at the upper end of said auxiliary distillation column;

(f) expanding a portion of the intermediate oxygen-enriched liquid and introducing same to the lower-pressure distillation column;

(g) removing a portion of the second nitrogen-rich gas from the upper end of the auxiliary distillation column, in an amount equal to the molar flow rate of between 20 and 70 percent of the molar flow rate of the low-pressure gas feed stream, as product;

(h) expanding substantially the remainder of the unexpanded intermediate oxygen-enriched liquid, separately from the liquid of step (f), and indirectly heat exchanging said remainder with unremoved second nitrogen-rich gas outside of the aforementioned distillation columns, condensing said unremoved second nitrogen-rich gas and at least partially vaporizing the remainder of the intermediate oxygen-enriched liquid;

(i) introducing at least a part of the condensed second nitrogen-rich vapor to the auxiliary distillation column as said colder liquid reflux therefore;

(j) introducing the expanded and at least partially vaporized oxygen-enriched mixture form in step (h) to the lower pressure distillation column; and (k) distilling the streams introduced to the lower pressure distillation column so as to produce a product stream of low-purity oxygen at the bottom thereof and a nitrogen-rich gas-stream at the top thereof.

2. The process of claim 1 wherein the high-pressure and low pressure gas feed streams are cooled and cleaned of air impurities by heat exchange with the product low-purity oxygen and nitrogen-rich gas streams, and wherein the remainder of the intermediate oxygen-enriched liquid is substantially completely vaporized in step (h).

3. The process of claim 2 further comprising the step of combining the first and second intermediate oxygen-enriched liquids in the lower end of the auxiliary distillation column.

4. The process of claim 2 wherein:

(a) the high-pressure feed stream comprises 50 to 60 percent of the total air feed, (b) the high-pressure feed stream is supplied at a pressure of at least 75 psia, (c) the low-pressure feed stream is supplied at a pressure of between 45 and 70 psia, and (d) the molar flow rate of nitrogen-rich gas removed from the upper end of the auxiliary distillation column is between 40 and 60 percent of the molar flow rate of the low-pressure feed stream.

5. The process of claim 2 wherein:

(a) the high-pressure feed stream comprises 52 to 56 percent of the total air feed, (b) the high-pressure feed stream is supplied at a pressure of between 75 to 95 psia, (c) the low-pressure feed stream is supplied at a pressure of between 50 to 65 psia, and (d) the molar flow rate of nitrogen-rich gas removed from the upper end of the auxiliary distillation column is between 45 and 55 percent of the molar flow rate of the low-pressure feed stream.

6. The process of claim 2 further comprising compressing substantially all of the feed air to a pressure of at least 65 psia, and work-expanding no more than 65 percent of the compressed feed air to a pressure of from 40 to 80 psia, thereby forming the low-pressure and high-pressure feed streams at the required pressures.

7. A process for producing low-purity oxygen from feed air by low-temperature distillation comprising the steps of:

(a) supplying a high-pressure gas feed stream, comprising at least 35 percent of said feed air, at pressure of at least 65 psia, in a cleaned, cooled state, (b) distilling said high-pressure gas feed stream in a higher-pressure distillation column so as to produce first intermediate oxygen-enriched liquid at the lower end and first nitrogen-rich gas at the upper end of said column, (c) heat exchanging the first nitrogen-rich gas with colder oxygen-enriched liquid so as to condense the first nitrogen-rich gas as reflux for said higher-pressure distillation column and a lower-pressure distillation column while simultaneously vaporizing the oxygen-enriched liquid as vapor for upward flow through said lower-pressure distillation column, (d) supplying a low-pressure gas feed stream, comprising no more than 65 percent of said feed air, at pressure of from 40 to 80 psia, but at least 10 psia less than the pressure of said high pressure feed stream, in a cleaned, cooled state, (e) distilling the low-pressure feed gas stream against a colder liquid reflux in an auxiliary distillation column so as to produce second intermediate oxygen-enriched liquid at the lower end and second nitrogen-rich gas at the upper end of said auxiliary distillation column, (f) expanding a portion of the intermediate oxygen-enriched liquid and introducing same to the lower-pressure distillation column, (g) removing a portion of the second nitrogen-rich gas from the upper end of the auxiliary distillation column, in an amount equal to the molar flow rate of between 20 and 70 percent of the molar flow rate of the low-pressure feed stream, as a product, (h) expanding the remainder of the intermediate oxygen-enriched liquid separately from the liquid of step (f) and feeding such expanded liquid to an auxiliary upper distillation column for donward flow therein so as to condense the second nitrogen-rich gas, as said colder liquid reflux for the auxiliary distillation column and as reflux for the auxiliary upper distillation column, (i) distilling the streams introduced to the auxiliary upper distillation column so as to produce a product nitrogen-rich gas stream at the upper end thereof and an oxygen-enriched gas at the lower end thereof, (j) introducing the oxygen-enriched gas produced in step (i) to the lower pressure distillation column, and (k) distilling the streams introduced to the lower pressure distillation column so as to produce a product stream of low-purity oxygen at the bottom thereof and a nitrogen-rich gas stream at the top thereof.

8. The process of claim 7 wherein the high-pressure and low-pressure feed streams are cooled and cleaned of air impurities by heat exchange with the product low-purity oxygen, and nitrogen-rich gas streams.

9. The process of claim 8 further comprising compressing substantially all of the feed air to a pressure of at least 65 psia, and work-expanding no more than 65 percent of the compressed feed air to a pressure of from 40 to 80 psia, thereby forming the low-pressure and high-pressure feed streams at the required pressures.

10. The process of claim 7 wherein:

(a) the high-pressure feed stream comprises 50 to 60 percent of the total feed air, (b) the high-pressure feed stream is supplied at pressure of at least 75 psia, and (c) the low-pressure feed stream is supplied at pressure of between 45 and 70 psia.

11. Apparatus for producing low-purity oxygen by air separation by low-temperature distillation comprising:

(a) means for compressing at least a first feed air stream to a pressure of at least 65 psia, (b) means for cooling at least said first stream, (c) a double distillation column comprising a higher-pressure distillation column for operation at a pressure of at least 65 psia, a lower-pressure distillation column for operation at a pressure no higher than 80 psia, but at least 10 psia less than said higher pressure distillation column and a heat exchanger joining the upper end of the higher-pressure distillation column and the lower end of the lower-pressure distillation column, (d) conduit means for flowing the cooled, first stream to the higher-pressure distillation column for separation therein, (e) means for supplying a second feed air stream at pressure of between 40 to 80 psia, in a cooled state, (f) an auxiliary distillation column with an auxiliary heat exchanger at its upper end, (g) conduit means for flowing the cooled, second feed air stream to the auxiliary distillation column, (h) conduit means for flowing nitrogen-rich liquid from the heat exchanger of part (c) to said lower-pressure distillation column, (i) conduit means for transferring intermediate oxygen enriched liquid to the lower pressure distillation column and separately to the auxiliary heat exchanger, (j) means for discharging a nitrogen-rich stream from the upper end of said auxiliary distillation column, (k) conduit means for flowing at least partially vaporized oxygen-enriched mixture from the auxiliary heat exchanger to the lower-pressure distillation colum, (l) means for discharging product low-purity oxygen from the lower end of the lower pressure distillation column, and (m) means for discharging a nitrogen-rich stream from the upper end of the lower pressure distillation column.

12. The apparatus of claim 11 wherein the cooling means of parts (b) and (e) are heat exchange means and further comprising conduit means for flowing the nitrogen-rich and low-purity oxygen streams to said heat exchange means.

13. The apparatus of claim 12 wherein the conduit means of part (i) comprise conduit means for flowing intermediate oxygen enriched liquid from the lower end of the higher-pressure distillation column to the lower end of the auxiliary distillation column, and conduit means for flowing intermediate oxygen enriched liquid from the lower end of an auxiliary distillation column to the lower-pressure distillation column and separately to the auxiliary heat exchanger.

14. The apparatus of claim 12 wherein the compressing means of part (a) is adapted to compress substantially all the feed air, and further comprising a turbine for expanding a portion of the cooled first feed air stream to a lower pressure of not more than 80 psia so as to produce external work and from said second feed air stream.

15. The process of claim 1 wherein the pressure of the low pressure gas feed stream is at least 20 psia less than the pressure of the high pressure gas feed stream.

16. The process of claim 1 wherein the high pressure distillation column is operated at pressure of 65 to 130 psia, the low pressure distillation column is operated at pressure of 18 to 30 psia and the auxiliary distillation column is operated at pressure of 40 to 80 psia.

17. The process of claim 1 wherein the oxygen content of the second nitrogen-rich gas removed from the upper end of the auxiliary distillation column is less than 2 mol%.

* * * * *